United States Patent [19]

Ives

[11] 4,431,880

[45] Feb. 14, 1984

[54] ROCKER SWITCH WITH INTEGRALLY DEFINED RETENTION MEANS FOR RESISTOR AND LAMP

[75] Inventor: Milton N. Ives, Wolcott, Conn.

[73] Assignee: Carlingswitch, Inc., West Hartford, Conn.

[21] Appl. No.: 466,966

[22] Filed: Feb. 16, 1983

[51] Int. Cl.[3] ..... H01H 9/16

[52] U.S. Cl. ..... 200/315; 200/313

[58] Field of Search ..... 200/315, 310, 313, 317

[56] References Cited

U.S. PATENT DOCUMENTS

| | | | |
|---|---|---|---|
| 2,494,560 | 1/1950 | Kaupp | 200/315 |
| 3,294,945 | 12/1966 | McLaughlin | 200/315 |
| 3,643,051 | 2/1972 | Foley | 200/275 |
| 3,732,388 | 5/1973 | Taylor | 200/315 |
| 3,743,805 | 7/1973 | Guinan | 200/315 |
| 4,064,380 | 12/1977 | Matthews | 200/313 |
| 4,101,749 | 7/1978 | Josemans et al. | 200/315 |

FOREIGN PATENT DOCUMENTS

| | | | |
|---|---|---|---|
| 1293886 | 4/1969 | Fed. Rep. of Germany | 200/315 |
| 2149498 | 4/1973 | Fed. Rep. of Germany | 200/315 |
| 2447378 | 4/1976 | Fed. Rep. of Germany | 200/315 |
| 2556461 | 6/1977 | Fed. Rep. of Germany | 200/315 |

*Primary Examiner*—John W. Shepperd

*Attorney, Agent, or Firm*—McCormick, Paulding & Huber

[57] ABSTRACT

A rocker switch has a spring biased movable contact which is continually connected to an electrical potential source and a lamp in the actuator has one lead connected to this spring and the other to a uniquely located resistor such that the resistor is connected selectively to one of the fixed switch contacts for illuminating the lamp. The lamp wires and the resistor are retained in the rocker by means which permits ease of assembly for these elements.

3 Claims, 4 Drawing Figures

ROCKER SWITCH WITH INTEGRALLY DEFINED RETENTION MEANS FOR RESISTOR AND LAMP

This invention relates generally to electrical switches of the type shown in issued U.S. Pat. No. 4,347,417, and deals more particularly with an illuminated actuator for such a switch.

Actuators of the illuminated type sometimes include a lamp mounted in the actuator itself and a pending application, Ser. No. 423,219 filed Sept. 24, 1982 held by the assignee herein, shows an illuminated rocker/actuator with a lamp mounted in the rocker and with a resistor circuit associated with the lamp in such a way that the resistor itself contacts a fixed contact in one position of the rocker to light the lamp. This pending application Ser. No. 423,219 is incorporated by reference herein.

The present invention deals with the configuration of the rocker and more specifically with the recess for retention of the resistor in the rocker, and also facilitating the assembly of the rocker with its resistor and lamp. Another benefit achieved with the present invention is in the retention of the lamp leads associated with the resistor and lamp.

In providing an electric switch with a selectively illuminated rocker the preferred form for the switch case has three fixed contacts in the bottom wall thereof, one of which contacts is always connected to a movable contact (preferably the center contact) and the other two of which contacts are selectively placed in electrical series circuit with the movable contact as a result of pivotable movement of the rocker. The resistor is preferably arranged in the rocker, and one of these other two fixed contacts is so shaped that in one position of the rocker a resistor circuit is closed by engagement between the resistor itself and said one of said other two fixed contacts. The rocker has a depending central portion or post cooperable with and adapted to so shift the movable contact as a result of such rocker movement. The resistor is retained in a downwardly open rocker recess adjacent one end of the rocker, and the lamp is located in a recess adjacent the opposite end of the rocker.

In accordance with the present invention this resistor recess has opposed generally cylindrical surfaces with their respective axes oriented at an acute angle to one another so that one of them guides the generally cylindrical recess into place during insertion at assembly, and so that the other of said cylindrical surfaces has a portion so spaced from the one surface that after having been so inserted the resistor can be pivoted about its innermost end until its outer end has moved past lips on the said other cylindrical surface to hold the resistor securely in place.

In further accordance with the present invention the lamp has two lead wires, and one of them is connected to a coil spring on the depending actuator portion so as to be connected in electrical series circuit with both the spring and the movable contact. The other lamp lead wire is connected to the inner end of the resistor, and both lamp lead wires are located at assembly by V-shaped slots in depending webs or walls of the actuator which walls are integrally defined and serve to provide the recess for the resistor and a central annular recess surrounding the depending post for receiving the spring.

FIG. 1 is a vertical sectional view through an improved switch having certain features common to the disclosure in the above-identified pending patent application, and illustrates the rocker/actuator in a first and second position (the latter being indicated in broken lines).

FIG. 2 is a vertical sectional view through the portion of the rocker actuator defining the resistor recess and also the annular recess for receiving the upper end of the spring (not shown). In FIG. 2 the resistor is shown in full lines and in exploded relation to the resistor recess, with an arrow indicating the direction for insertion of the resistor in said recess, and the resistor is shown again in broken lines after assembly, that is after being pivoted about its inner end to lock the resistor in its recess.

Figure 1:
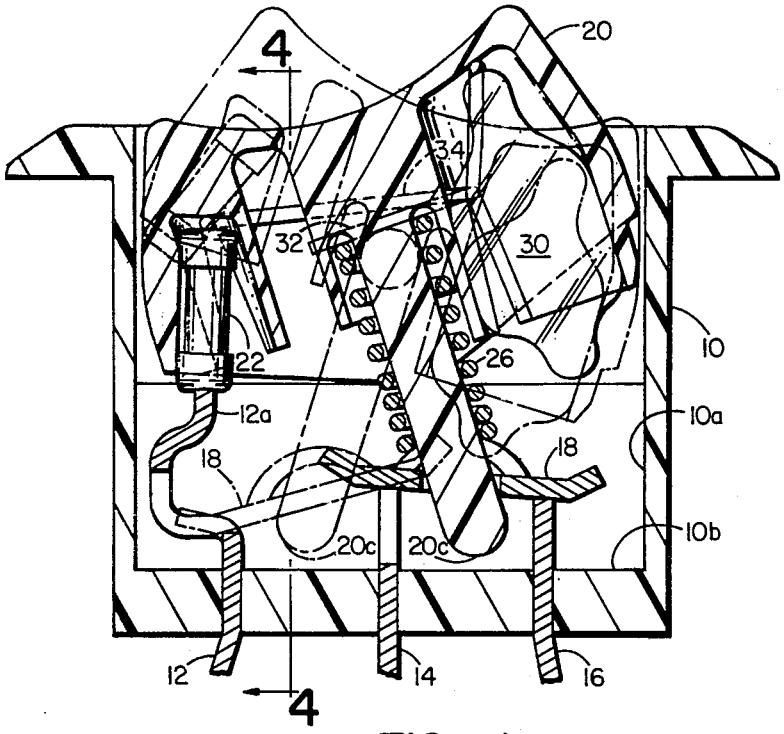

Turning now to the drawings in greater detail, FIGS. 1–4 inclusively show a preferred embodiment for an electrical rocker switch of the type having an illuminated rocker, and which switch is well adapted to low cost high quantity mass production for reasons to be described.

The switch includes a molded plastic base 10 having an upwardly open cavity 10*a* which cavity is defined in part by a bottom wall 10*b*. Three fixed contacts 12, 14 and 16 are provided in the bottom wall 10*b* of the plastic case 10 and one of these contacts 14 is located centrally of the generally rectangular switch base with the other two contacts 12 and 16 being spaced therefrom and having portions adapted to be engaged by opposite ends of a movable contact 18. The movable contact 18 may be identical to that shown and described in U.S. Pat. No. 4,347,417 and it is a feature of the present invention that this movable contact 18 is adapted to be moved from the solid line position shown to the broken line position as a result of pivotal movement of rocker 20 from the position shown in full lines in FIG. 1 to that suggested in broken lines therein.

Still with reference to U.S. Pat. No. 4,347,417 and the related pending application Ser. No. 423,219 it is a further feature of this type of electrical switch that a coil spring 26 is provided on a depending central post portion 20*c* of the actuator in order that the lower end of this spring 26 engage, continually, the movable contact 18 to be maintained at an electrical potential equivalent to that of the movable contact 18. Thus, in the position shown in FIG. 1 and with a load voltage applied to contact 14 a circuit is created as long as contact 16 is connected to ground or neutral. So too, with the contact 18 in the broken line position shown in FIG. 1 and the same load applied to central contact 14 a circuit is created through contact 12, which may be ground or neutral.

In accordance with the present invention means is provided for selectively opening and closing a resistor circuit defined in large part by elements located in the actuator 20, and more particularly by a resistor 22, lamp 30, and associated lamp lead wires, 32 and 34. As shown in FIG. 1 lead wire 32 from lamp 30 is electrically connected to the upper end of spring 26 and lamp lead wire 34 is electrically connected to the upper resistor 22. Thus, when the actuator 20 is in the position shown the lower end of resistor 22 contacts the upper end 12*a* of fixed contact 12 in much the same manner as described in the above mentioned pending patent application Ser. No. 423,219. While the specific geometry of the preferred embodiment shown in FIG. 1 differs from that in the pending application providing significant improvement thereover both switch constructions are electrically similar to one another in that they both are adapted to operate in the same manner, that is with the lamp being lit in the solid line position shown and with the lamp being off in the broken line position.

Figure 2:
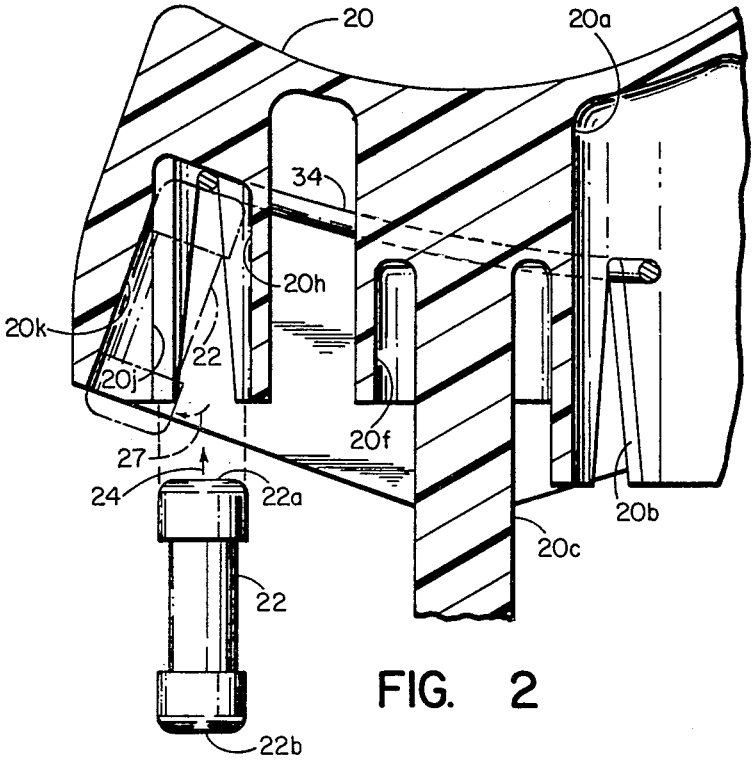
Figure 3:
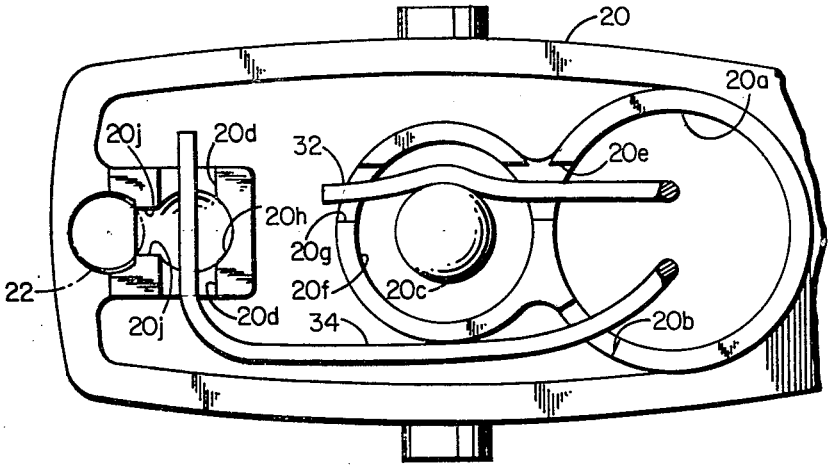
FIG. 3 is a bottom view of the rocker/actuator depicted in FIG. 2 with the lamp lead wires in assembled position but prior to assembly of the resistor and coil spring.
Figure 4:
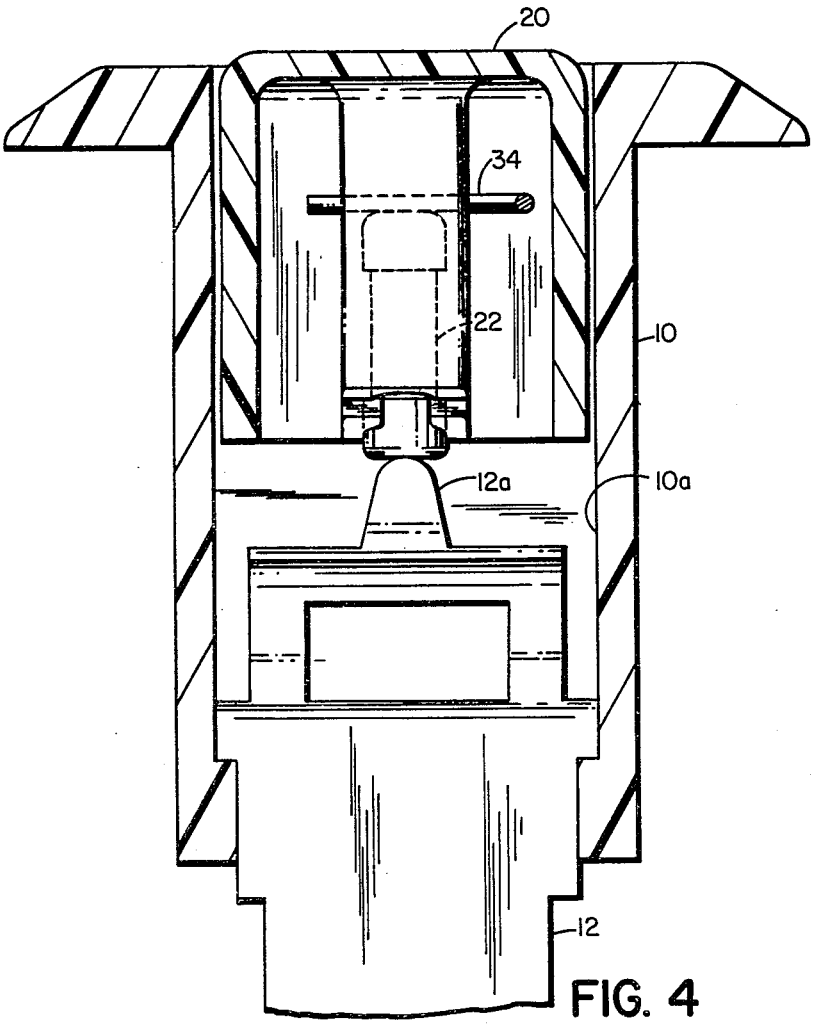
FIG. 4 is a vertical sectional view taken generally on the line 4—4 of FIG. 1.

Turning next to a detailed description of the specific configuration for the actuator 20 and particularly the retention means for retaining the lead wires for the lamp, FIG. 2 shows the actuator with its central depending post 20*c* adapted to slidably receive the spring (not shown). The lamp 30 (also not shown in this view) is adapted to be slidably received in a recess 20*a* and it is a feature of the present invention that one of the lamp lead wires 34 has a portion adapted to be received in a slot 20*b* defined in a depending web or wall defined integrally with the rocker/actuator 20. As also shown in FIG. 3 the V-shaped slot 20*b* receives lead wire 34, which lead wire has an end portion adapted to be received in similarly shaped slots 20*d*, 20*d* defined for this purpose in the depending web walls of the resistor recess. The other lamp lead wire 32 also passes through a V-shaped slot 20*e* in the lamp recess sidewall and extends through the annular recess 20*f* so as to contact the upper end of the spring (not shown). This lamp lead wire 32 has an end portion extending through a slot 20*g* in this annular recess sidewall 20*f* as best shown in FIG. 3. As so constructed and arranged the resistor circuit provided in the actuator 20 will always include the spring, the lamp leads 32 and 34, the lamp 30 (not shown) and the resistor 22 so that a circuit is closed when the lower end of resistor 22 contacts the upper end 12*a* of fixed contact 12 as described previously.

Turning next to a more detailed description of the manner in which the resistor 22 is assembled with the actuator 20, and more particularly with the resistor recess, FIG. 2 shows the resistor initially inserted in the direction of arrow 24. That the resistor 22 is generally cylindrical in configuration and moves parallel to a generally cylindrical surface 20*h* defined in a depending web or wall of the actuator 20 for this purpose. Once the inner end 22*a* of resistor 22 contacts the wire 34 the resistor 22 is pivoted in the direction of arrow 26 until the lower end portion of the resistor 22 moves past lips 20*j*, 20*j* in order to releasably retain the resistor 22 in the broken line position shown in FIGS. 2 and 3. These lips 20*j* and 20*j* also serve to guide the resistor 22 during vertical insertion in the direction of the arrow 24 in FIG. 2 in addition to providing retention means for the resistor such that it can be conveniently assembled with the actuator 20 and so that it is securely held in the actuator following assembly in accordance with the procedure described herein.

As so constructed and arranged the actuator is well adapted to being assembled with its lamp and resistor in an automated production line. The V-shaped slot defined between the angled surfaces 20*h* and 20*k* will accommodate a tool (not shown) such that resistor 22 can be pivoted into position as described above. As so assembled the resistor retains lamp lead wire 34 in place. Lamp 30 is also well adapted to assembly as described above, the lead wires being efficiently guided into place by the V-shaped slots 20*b*, 20*e*, 20*g* and 20*d*, 20*d*.

I claim:

1. In an electric switch having a case defining a cavity for several fixed contacts and having an actuator movably mounted in the case for shifting a movable contact between at least two positions associated with certain of these fixed contacts to provide at least two switch conditions, the improvement to said actuator comprising a depending central portion cooperable with and adapted to so shift the movable contact in response to actuator movement, an electrically energizable lamp, a downwardly open recess to receive said lamp, a generally cylindrical resistor in electrical series with said lamp, a downwardly open recess for a resistor, said resistor recess being spaced from said lamp recess so that said recesses are provided adjacent opposite ends of said actuator and on either side of said depending central portion, said resistor recess defined by opposed concave surfaces of axially elongated generally cylindrical contour and oriented at an acute angle with respect to one another so that one said concave cylindrical surface serves to guide the resistor into place during insertion in said recess and the other said concave cylindrical surface having a portion inclined with respect to said one surface and spaced therefrom so that after insertion said resistor can be pivoted about its inner end until its outer end abuts said other concave cylindrical surface, and said other surface having resistor retention lips associated therewith to secure said resistor in said recess by engagement with said resistor outer end.

2. In a switch as defined in claim 1 wherein said depending central actuator portion comprises a post and a conductive spring received on said post, one end of said spring engaging said movable contact and an opposite end of said spring received in an annular recess defined by said actuator in concentric relation to said depending post, lamp leads for said lamp, one lamp lead connected to said spring opposite end and a second lamp lead connected to said resistor inner end.

3. In a switch as defined in claim 2 wherein said actuator comprises a rocker of light transmitting plastic and having a downwardly open recess with sides, ends, and a bottom wall, said resistor recess and lamp recess defined by depending integrally formed webs connected to said bottom wall and defined in part by said ends of said actuator, and said annular recess also defined by an annular web integrally connected to said bottom wall, said lamp recess defining web and said annular spring recess defining web having aligned V-shaped slots to receive and locate said lamp lead connected to said spring and a second V-shaped slot in said lamp recess web to receive and locate said second lamp lead.

* * * * *